United States Patent [19]

Miller et al.

[11] Patent Number: 5,066,898

[45] Date of Patent: Nov. 19, 1991

[54] MULTI-WAY SWITCH SYSTEM HAVING PLURAL REMOTE TOUCH PADS

[75] Inventors: Ronald E. Miller, Zanesville; Robert L. James, Cambridge, both of Ohio

[73] Assignee: Delat Systems, Incorporated, Cambridge, Ohio

[21] Appl. No.: 518,464

[22] Filed: May 3, 1990

[51] Int. Cl.[5] ..... H05B 37/02

[52] U.S. Cl. ..... 315/362; 307/116; 323/904

[58] Field of Search ..... 315/362; 307/114, 116, 307/117, 125, 130, 139, 140; 323/904, 905, 322

[56] References Cited

U.S. PATENT DOCUMENTS 4,525,634 6/1985 Southard ..... 315/362

4,591,765 5/1986 Beck ..... 307/140

4,651,022 3/1987 Cowley ..... 315/362

4,758,735 7/1988 Ingraham ..... 307/116

4,939,382 7/1990 Gruodis ..... 323/904

*Primary Examiner*—Eugene R. LaRoche

*Assistant Examiner*—Amir Zarabian

*Attorney, Agent, or Firm*—Cushman, Darby & Cushman

[57] ABSTRACT

A multi-way electronic control switch having a central control unit and a plurality of remote touch pads. The central control unit is wired between power and a load, and may be wired as a single pole, single throw switch. Each remote touch pad is connected to the central control unit via a single conducting wire. The central control unit senses signals from a remote touch pad and varies the power to the load accordingly.

9 Claims, 4 Drawing Sheets

MULTI-WAY SWITCH SYSTEM HAVING PLURAL REMOTE TOUCH PADS

BACKGROUND OF THE INVENTION

1. Field of the Invention

The present invention relates to multi-way switch systems, having a plurality of remote touch pads, which can be installed in the same way for all standard single pole, single throw circuits and electrical fixtures encountered in residential or commercial buildings.

2. Background and Related Art

A multi-way switch system comprises a plurality of switches, remotely separated from one another, each of which may independently control power to a load. For example, a three-way switch system employed to control a lamp in a home may have two switches located on two different walls of a room. Each switch may turn on, turn off or dim the lamp, thereby enabling a home owner to control the lamp from two different room locations. Accordingly, an electrician simply wires the lamp to one of the switches, and then interconnects all remote switches, such that each switch may actuate the lamp from its remote location.

In such a conventional wiring configuration, the house current and voltage must be conducted through both switches before reaching the load. Thus, if additional remote switches are desired, house power must also be routed through each additional switch. As a result, house power is not efficiently conducted to the load.

Moreover, special skills and knowledge are required to install a conventional switch system for two reasons. First, each individual switch must be wired separately to adapt to a specific function. For example, a single pole, single throw (SPST) switch is installed differently than a three-way dimmer switch. These wiring variations for each individual switch increase the possibility of wiring errors which may short the system or otherwise render it inoperable. Second, all of the switches must be electrically interconnected such that each switch can control power to the load.

There are currently two different ways to install multi-way switch systems, depending upon whether the power is supplied at one of the switches, or at the load. This further increases the possibility of wiring errors. Such errors can be dangerous and are obviously costly to locate and correct.

As can be appreciated from numerous wiring variations, conventional systems inherently require a long installation time.

Inventors have attempted to develop more simplistic multi-way switch systems. For example, U.S. Pat. No. 4,087,702 to Kirby et al., U.S. Pat. No. 4,562,592 to Yuhasz et al., U.S. Pat. No. 4,698,547 to Rowen et al., and U.S. Pat. No. 4,745,351 to Rowen et al. all disclose various multi-way switch systems employing remote control switches or touch pads. However, each of these prior art switch systems requires multiple wires to connect each remote switch to the system base, thereby failing to reduce the wiring complexity or installation time. Such switch systems require trained electricians to insure safe installation.

The prior art switch systems discussed above have an additional shortcoming in that each requires a circuit element such as an SPST switch, a push button switch, and/or other active components at each remote switching location. Thus, one of the multiple wires used to connect a remote switch to the system must be connected to an AC power lead to supply power to this remote circuit element. Accordingly, such prior art switch systems fail to efficiently conduct power directly to the load.

Thus, a switch system is desirable wherein: installation is reduced to the lowest level of complexity; remote switches control power supply to the load as effectively as the central switch, yet do not require remote logic circuitry; and power is conducted directly to the load, rather than through a series of switches.

SUMMARY OF THE INVENTION

An object of the present invention is to reduce the complexity of installing multi-way switch systems by employing a single wire to connect remote touch pads to a central control switch.

Another object of the present invention is to provide a switch system in which remote touch pads control the load as effectively as the central control switch, yet without requiring additional circuit elements.

Still yet another object of the present invention is to provide a multi-way switch system which efficiently conducts power directly to the load.

To achieve these objects, the present invention comprises a multi-way switch system having an electronic touch control switch located at a central location connected by a single wire to a plurality of touch pads each located at a separate remote location. The control switch, comprising a central touch pad and control circuitry, is wired as a simple SPST switch between power and load. The central touch pad generates signals which actuate the control circuitry to control power to the load in a desired manner.

The touch pads positioned remotely from the control switch are connected to the control switch with only one wire. This single wire connects the remote touch pads to the control switch such that signals from the remote touch pads are input to the control circuitry in the same way as signals from the central touch pad. The control circuitry cannot discern whether the signals have originated from the central touch pad or from the remote touch pads. Thus, the circuitry functions the same regardless of whether the signal is generated by the central touch pad or by one of the remote touch pads.

Accordingly, the present invention provides a simple and effective multi-way switch system. Installation time and wiring complexity is reduced, and wiring errors are practically eliminated. Furthermore, power is efficiently conducted to the load.

BRIEF DESCRIPTION OF THE DRAWINGS

These and other advantages will become more apparent from the following detailed description of preferred embodiments of the invention when considered with the following drawings wherein.

DETAILED DESCRIPTION OF THE INVENTION

Figure 1:
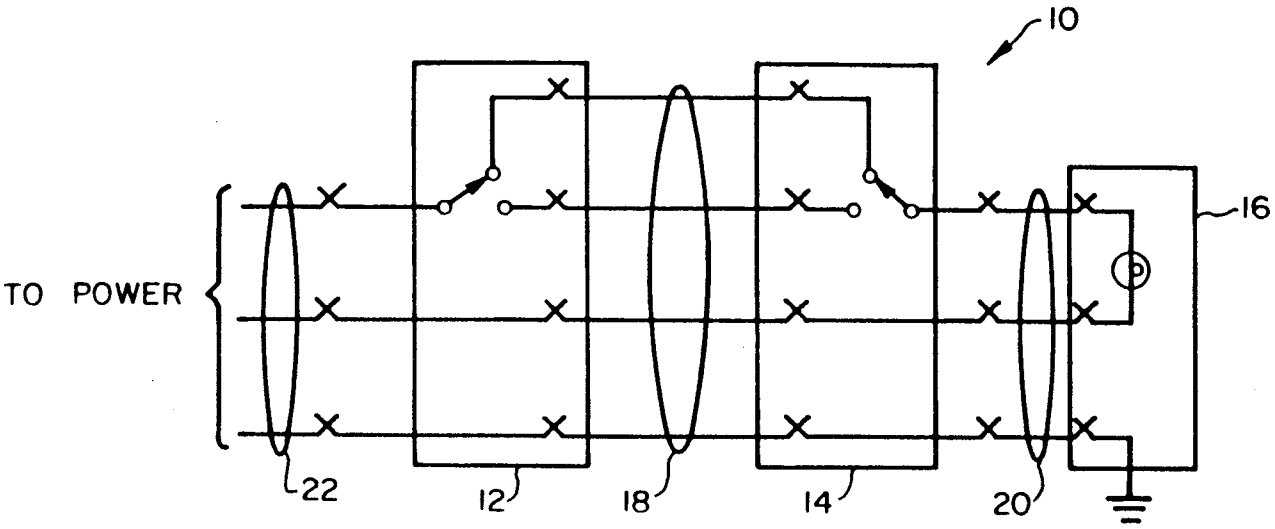
FIG. 1 (PRIOR ART)
FIG. 1 is a wiring configuration of a conventional multi-way switch system.

FIG. 1 depicts a conventional wiring configuration of switch system 10 comprising two switches 12 and 14 and load 16. Switch 12 is connected to power (for example, 115 VAC, 60 Hz house power) via three wire cable 22, which is a standard two conductors plus ground cable. The power is routed through switch 12 to switch 14 via four wire cable 18 (i.e., three conductors plus ground), and switch 14 is connected to load 16 via three wire cable 20. Accordingly, both switches 12 and 14 can control the flow of power to load 16.

Figure 2:
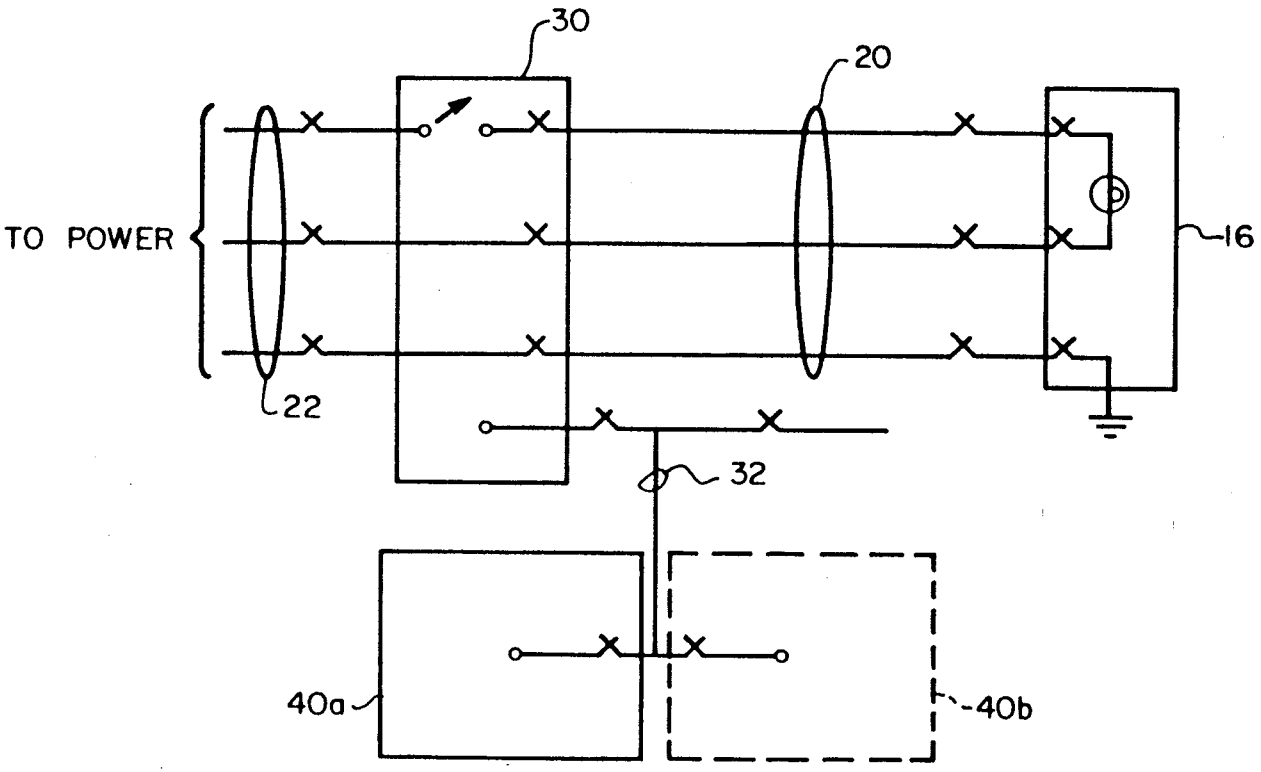
FIG. 2 is a wiring configuration for a multi-way switch system according to the present invention.

FIG. 2 illustrates a switch system according to the present invention. Control switch 30 is wired to power (for example, 115 VAC, 60 Hz house power) via cable 22, which is a standard two conductor plus ground cable arrangement. Load 16 is connected to control switch 30 via cable 20, which also is a two conductor plus ground cable type. When control switch 30 is activated, load 16 is coupled directly to the house power via cable 22, control switch 30 and cable 20.

Remote touch pads 40*a*, 40*b* are connected to the control switch 30 via single wire 32. Although only two remote touch pads 40*a*, 40*b* are shown in FIG. 2, should be understood that additional multiple remote touch pads may be coupled t control switch 30 via single wire 32.

According to the wiring configuration of the present invention, only control switch 30 is coupled to the house power. Furthermore, control switch 30 is wired as a simple SPST switch coupled between house power and load 16, regardless of the particular kind of control switch used (for example, the switch type may be single pole on-off; three-way on-off; multi-way on-off; a single pole, continuously variable dimmer; a three-way continuously variable dimmer; a multiple location continuously variable dimmer; a single pole, step dimmer with delay off; a three-way step dimmer with delay off; or a multiple location step dimmer with delay off). To then electrically connect remote touch pads 40*a*, 40*b*, a single wire 32 is run between control switch 30 and each remote touch pad 40*a*, 40*b*.

Figure 3:
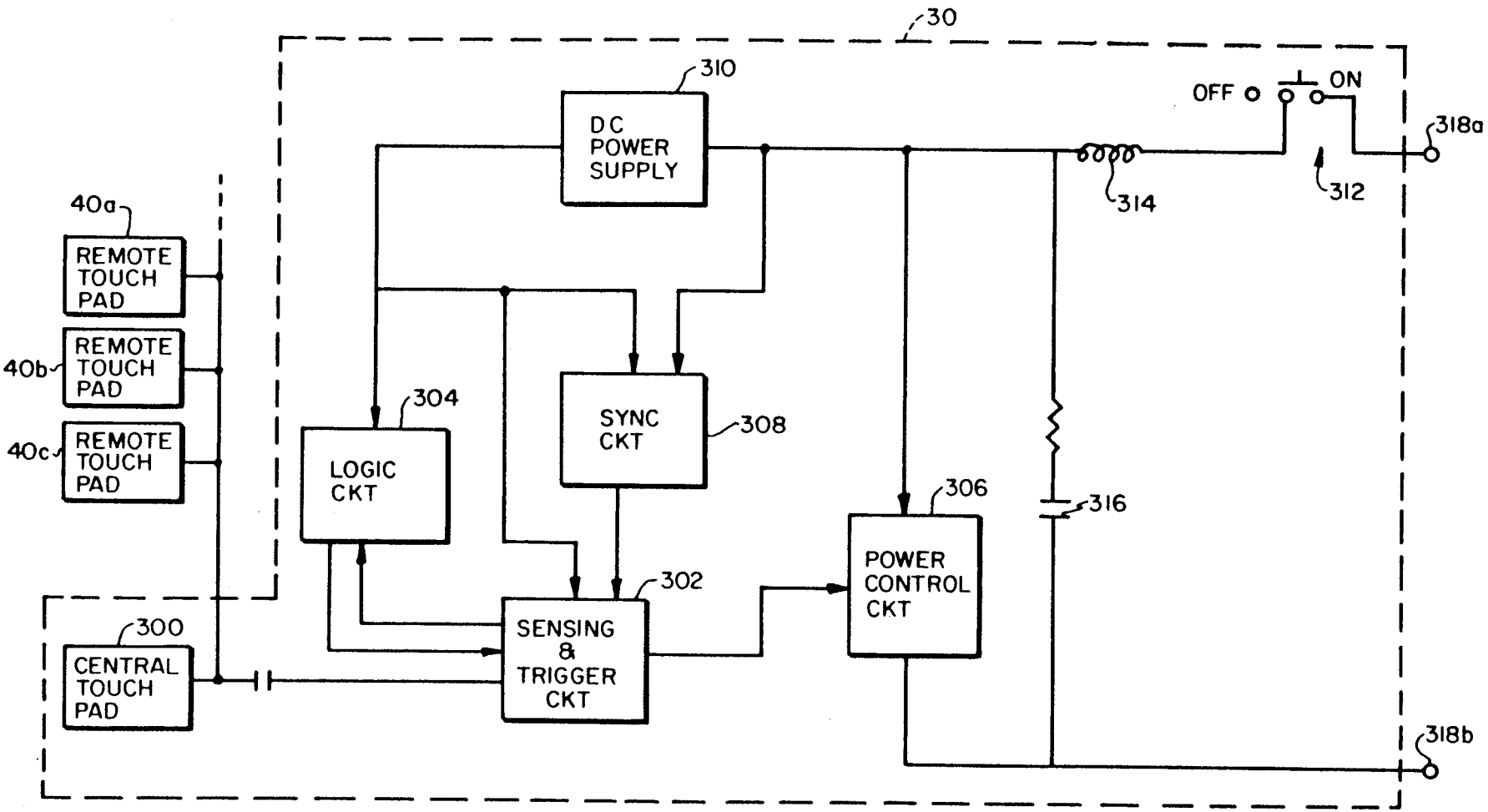
FIG. 3 is a block diagram detailing the control circuitry portion of a multi-way switch system according to the present invention.

FIG. 3 is a block diagram illustrating details of the control circuitry portion of the invention. Touch pads 40*a*, 40*b*, 40*c* (located remotely from control switch 30) and a central touch pad 300 (located at the control switch 30) are all connected to a sensing and trigger circuit 302, which responds to an output signal from any one of the touch pads.

When an output signal is detected, logic circuit 304 responds to the sensing of that signal to control the trigger circuit 302 in providing an output to power control circuit 306 (for example, a triac which may be electronically turned on and off each half cycle of the 60 cycle power). Synchronization circuit 308 provides timing signals coordinating the operation of sensing and trigger circuit 302. DC power supply 310 supplies biasing to drive sensing and trigger circuit 302, logic circuit 304 and synchronization circuit 308.

A slide switch 312 selectively connects the control switch 30 to house power and the load, which are joined to terminals 318*a* and 318*b*. When slide switch 312 is OFF, an air gap is formed in series with the AC current line, thereby disconnecting power from the control circuitry. When slide switch 312 is ON, the house power is connected to the control circuitry.

Inductor 314 and capacitor 316 provide a simple filter to minimize the effect of transients or surges generated by external sources.

In operation, slide switch 312 is placed in the ON position. When a person touches one of the remote touch pads 40*a*, 40*b*, 40*c*, or central touch pad 300, the person acts as an antenna and generates a noise signal. In the sensing and trigger circuit 302, the noise signal is rectified and compared with a predetermined voltage level. When the voltage level of the noise signal exceeds the predetermined value, sensing and trigger circuit 302 activates logic circuit 304 (detailed examples of which are provided below).

Logic circuit 304 generates an output signal which is used by sensing and trigger circuit 302 to control the operation of power control circuit 306. More particularly, sensing and trigger circuit 302 generates a control signal, synchronized by the output signal from synchronization circuit 308, to control power control circuit 306. Operation of power control circuit 306 completes the circuit between house power and the load.

It should be noted that since central touch pad 300 and remote touch pads 40*a*, 40*b*, 40*c* all produce noise when touched, sensing and trigger circuit 302 is indifferent to whether the noise is generated by central touch pad 300 or by one of the remote touch pads 40*a*, 40*b*, 40*c*. Accordingly, remote touch pads 40*a*, 40*b*, 40*c* control the control switch 30 as effectively as central touch pad 300.

Logic circuit 304 may be designed to accommodate different types of switching operations. Three types (touch on-touch off; touch on, continuously variable dimmer - hold-touch off; and touch on-touch step dimmer-touch delay off) will be described below.

1. Touch On-Touch Off

When a first touch is detected by sensing and trigger circuit 302 (i.e., a person touches one of the touch pads which results in the generation of noise sufficient to exceed the predetermined value), a signal is sent from circuit 302 to activate logic circuit 304. Circuit 304 then causes sensing and trigger circuit 302 to turn on power control circuit 306 to thereby deliver full house power to the load.

Upon a second touch, sensing and trigger circuit 302 sends another signal to logic circuit 304 which, in turn, produces an output causing power control circuit 306 to interrupt current flow therethrough thereby turning off the power to the load.

2. Touch On, Continuously Variable Dimmer - Hold - Touch Off

When a first touch is detected, logic circuit 304 directs sensing and trigger circuit 302 to turn on power control circuit 306. Sensing and trigger circuit 302 then controls the amount of power flowing to the load through power control circuit 306 according to a timing relationship between the turn on signal received from the logic circuit 304 and a zero crossing of the synchronization signal produced by circuit 308. A short time interval between the zero crossing signal and the turn on signal causes power control circuit 306 to conduct more power to the load whereas a longer time interval results in less power to the load. Accordingly, if the load were a light source, for example, the light emitted would decrease as the time intervals became longer.

When a second touch is sensed by sensing and trigger circuit 302, logic circuit 304 steps to a HOLD state and generates a signal directing sensing and trigger circuit 302 to maintain the existing time interval between the zero crossing signal produced by synchronization circuit 308 and the turn on signal produced by logic circuit 304.

When a third touch is sensed by circuit 302, the logic circuit 304 directs sensing and trigger circuit 302 to turn off the power control circuit 306, thereby terminating the application of power to the load.

3. Touch On-Touch Step Dimmer-Touch Delay Off

Upon a first touch, logic circuit 304 generates an ON-LOW signal which, when combined with a signal from synchronization circuit 308, directs sensing and trigger circuit 302 to turn on power control circuit 306 so as to conduct only about 35% of the available power to the load. When a second touch occurs, logic circuit 304 generates an ON-MEDIUM signal directing sensing and trigger circuit 302 to instruct power control circuit 306 to carry approximately 65% of the available power to the load. Upon a third touch, logic circuit 304 generates an ON-HIGH signal which results in having control circuit 306 direct full power to the load.

Upon sensing a fourth touch, logic circuit 304 steps to a DELAY-OFF state. Logic circuit 304 directs sensing and trigger circuit 302 to interrupt the current flow through power control circuit 306 for approximately 0.5 seconds. Simultaneously, logic circuit 302 starts a 60 second timer. If no further touch is sensed within the 60 second period, sensing and trigger circuit 302 turns off power control circuit 306. On the other hand, if a touch is sensed within the 60 second period, the 60 second timer is terminated and logic circuit 304 steps to the OFF state. Logic circuit 304 then directs sensing and trigger circuit 302 to turn off power control circuit 306.

It is to be understood that the three switching operations described above are merely examples of various switching operations which are intended to be within the scope of the present invention.

The present invention is an improvement over prior art switch systems in that the logic circuit is contained only within central switch 30. No logic circuitry, or active components, exist in remote switches 40*a*, 40*b*, 40*c*. This central location of logic facilitates simplified single wiring to each remote switch 40.

Figure 4:
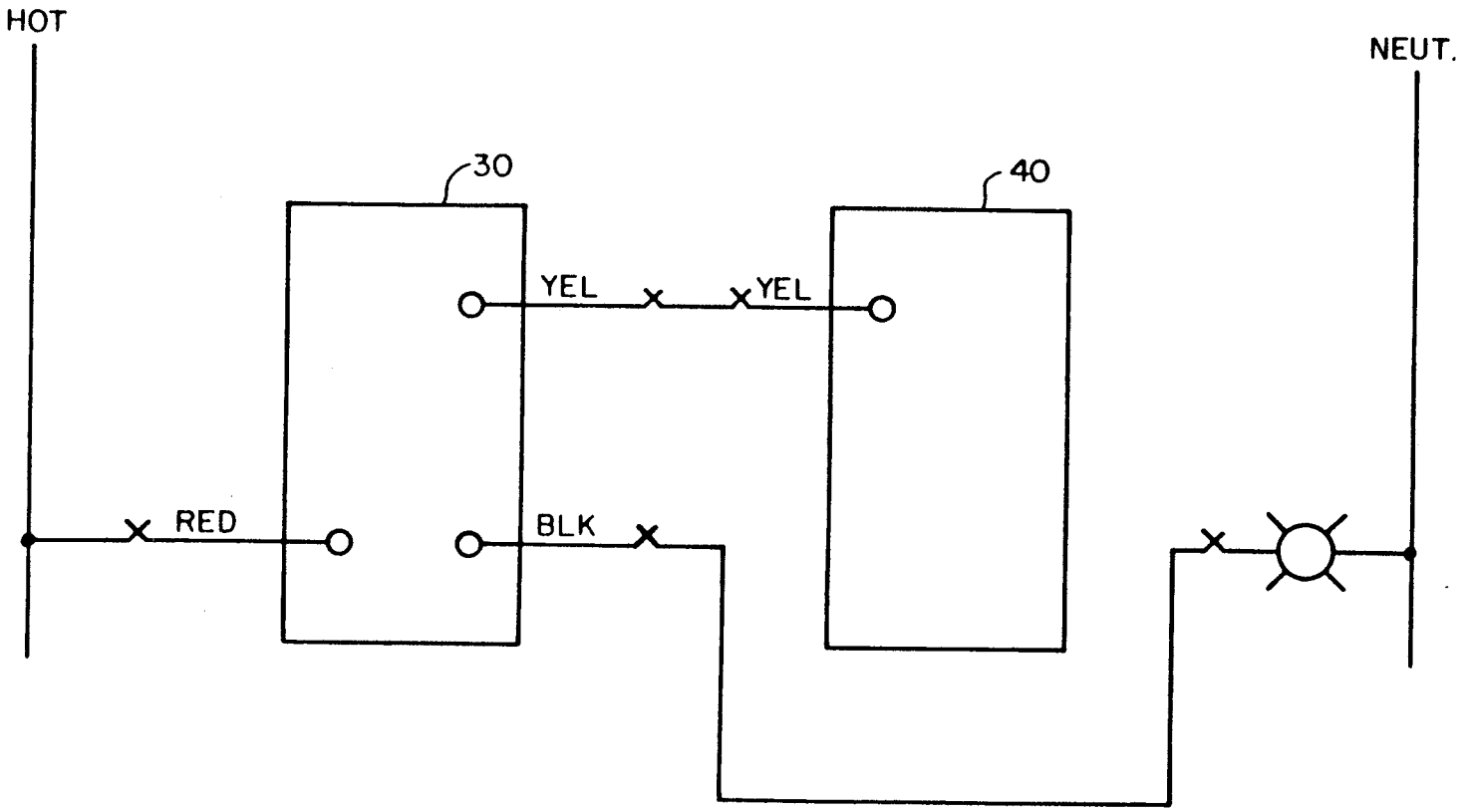
FIG. 4 illustrate the wiring for a three-way switch system according to the present invention.

FIG. 4 shows the wiring for the invention when used in a three-way switch system and adopting known wiring color schemes. Control switch 30 is connected to a hot line by a red wire and is connected to a neutral line by a black wire. Each remote touch pad 40 is then wired to control switch 30 with yellow wire. Control switch 30 is wire as an SPST switch coupled to each remote touch pad 40 by a single yellow wire. Although only one remote touch pad 40 is shown, multiple remote touch pads may be joined to the single yellow wire.

To summarize, the present invention allows a standard wiring method to be employed for all electrical fixtures throughout the house. All switch circuits are wired as single pole, single throw switches. To convert a single switch to a multi-switch system, additional remote touch pads are joined to the control switch with one wire.

The present invention substantially reduces installation costs, including electrician time and material costs. Wiring errors also are reduced because all single pole, dimmer and/or delay switches, three-way, four-way, or other multi-switch systems are wired exactly the same. Additionally, the present invention efficiently conducts house power directly to the intended load through a single control switch, rather than through two or more switches, as taught in conventional switch systems.

It is to be understood that the invention is not limited to the disclosed embodiment, but is intended to cover various modifications and equivalent arrangements included within the spirit and scope of the appended claims.

I claim:

1. A multi-way switch system comprising:

at least one remote switching means for generating an activation signal;

central switching means, located remotely from said remote switching means and coupled thereto by a single conducting wire, for controlling power to a load, said central switching means comprising:

means for sensing the activation signal produced by said remote switching means;

logic means responsive to said activation signal for producing a control signal;

means joined to the logic for receiving said control signal and producing a trigger signal;

means for providing a synchronization signal to synchronize said trigger signal; and power control means responsive to the synchronized trigger signal for controlling power applied to the load, wherein the power to the load is varied in accordance with a time interval between said control signal and said synchronization signal, the power being reduced as the time interval becomes longer.

2. A multi-way switch system comprising:

at least one remote switching means for generating an activation signal;

central switching means, located remotely from said remote switching means and coupled thereto by a single conducting wire, for controlling power to a load, said central switching means comprising:

means for sensing the activation signal produced by said remote switching means;

logic means responsive to said activation signal for producing a control signal;

means joined to the logic for receiving said control signal and producing a trigger signal;

means for providing a synchronization signal to synchronize said trigger signal; and power control means responsive to the synchronized trigger signal for controlling power applied to the load, wherein the power to the load is varied in a step-like manner, with each activation signal initiating a step change of a predetermined amount of power.

3. A multi-way switch system comprising:

at least one remote switching means for generating an activation signal;

central switching means, located remotely from said remote switching means and coupled thereto by a single conducting wire, for controlling power to a load, said central switching means comprising:

means for sensing the activation signal produced by said remote switching means;

logic means responsive to said activation signal for producing a control signal, said logic means comprising means for counting a predetermined time period, the power to the load being terminated when the predetermined time period elapses, or when an activation signal is sensed during counting of the time period;

means joined to the logic for receiving said control signal and producing a trigger signal;

means for providing a synchronization signal to synchronize said trigger signal; and power control means responsive to the synchronized trigger signal for controlling power applied to the load.

4. A multi-way switch system according to claims 1 or 3, wherein said central switching means is coupled between a source of power and the load.

5. A multi-way switch system according to claims 1 or 3, wherein said central switching means is wired as a single pole, single throw switch.

6. A multi-way switch system according to claims 1 or 3, wherein said remote switching means comprises a pad sensitive to touch.

7. A multi-way switch system according to claims 1 or 3, wherein the load is a lamp, and said central switching means operates to control power to said lamp.

8. A multi-way switch system according to claims 1 or 3, wherein the load is a lamp, and said central switching means operates to switch said lamp on and off.

9. A multi-way switch system according to claims 1 or 3, wherein said central switching means further comprises means for supplying bias voltage to said sensing, logic and synchronization means.

* * * * *

UNITED STATES PATENT AND TRADEMARK OFFICE

CERTIFICATE OF CORRECTION

PATENT NO. : 5,066,898

DATED : NOVEMBER 19, 1991

INVENTOR(S) : Ronald E. Miller and Robert L. James

It is certified that error appears in the above-identified patent and that said Letters Patent is hereby corrected as shown below:

On the Title page,

Please correct the name of the Assignee to:

-- DELTA SYSTEMS, INCORPORATED --

Signed and Sealed this

Sixth Day of April, 1993

*Attest:*

STEPHEN G. KUNIN

*Attesting Officer*

*Acting Commissioner of Patents and Trademarks*